US008922131B1

(12) United States Patent
Xiong

(10) Patent No.: US 8,922,131 B1
(45) Date of Patent: Dec. 30, 2014

(54) SERIES RESONANT INVERTER WITH CAPACITIVE POWER COMPENSATION FOR MULTIPLE LAMP PARALLEL OPERATION

(75) Inventor: Wei Xiong, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 187 days.

(21) Appl. No.: 13/558,091

(22) Filed: Jul. 25, 2012

Related U.S. Application Data

(60) Provisional application No. 61/545,296, filed on Oct. 10, 2011.

(51) Int. Cl.
*H05B 41/16* (2006.01)

(52) U.S. Cl.
USPC ..... 315/246; 315/209 R; 315/258; 315/312

(58) Field of Classification Search
CPC ..... H05B 41/2928; H05B 37/029; H05B 41/232; H05B 41/28
USPC ..... 315/246, 312, 209 R, 258
See application file for complete search history.

(56) References Cited

U.S. PATENT DOCUMENTS

| | | | | |
|---|---|---|---|---|
| 4,525,649 | A | 6/1985 | Knoll et al. | |
| 4,641,061 | A | 2/1987 | Munson | |
| 5,903,446 | A | 5/1999 | Huillet et al. | |
| 6,020,691 | A | 2/2000 | Sun et al. | |
| 6,111,369 | A | 8/2000 | Pinchuk et al. | |
| 6,232,726 | B1 | 5/2001 | Janczak | |
| 6,433,490 | B2 | 8/2002 | Koch et al. | |
| 6,815,908 | B2 | 11/2004 | Glaser et al. | |
| 6,867,553 | B2 | 3/2005 | Nerone et al. | |
| 6,936,970 | B2 | 8/2005 | Chen et al. | |
| 7,042,171 | B1 | 5/2006 | Lin | |
| 7,176,639 | B2 | 2/2007 | Hu et al. | |
| 7,239,091 | B2 | 7/2007 | Shinmen et al. | |
| 7,352,139 | B2 * | 4/2008 | Ribarich et al. | 315/312 |
| 7,372,215 | B2 | 5/2008 | Sekine et al. | |
| 7,839,094 | B2 | 11/2010 | Nerone | |
| 7,876,060 | B2 | 1/2011 | Alexandrov | |
| 2004/0228153 | A1 | 11/2004 | Cao et al. | |
| 2007/0176564 | A1 | 8/2007 | Nerone et al. | |
| 2008/0054816 | A1 * | 3/2008 | Shackle et al. | 315/209 R |
| 2009/0115341 | A1 * | 5/2009 | Nijhof et al. | 315/246 |

* cited by examiner

*Primary Examiner* — Thuy Vinh Tran
*Assistant Examiner* — Syed M Kaiser
(74) *Attorney, Agent, or Firm* — Waddey Patterson; Mark J. Patterson; Mark A. Pitchford

(57) ABSTRACT

A light fixture includes a housing, a plurality of parallel lamps, and a ballast. The ballast provides power to each lamp of the plurality of parallel lamps. A series resonant inverter in the ballast provides AC power to an output of the series resonant inverter from a DC power source having a power rail and a ground. The series resonant inverter includes a resonant inductor, a first clamping diode, and a second clamping diode. The resonant inductor has a first portion and a second portion and a connection point between the first portion and the second portion. The first clamping diode is connected between the connection point and the power rail. The second clamping diode is connected between the connection point and the ground. The first and second clamping diodes ensure soft switching of a half-bridge inverter switch pair of the series resonant inverter.

17 Claims, 4 Drawing Sheets

SERIES RESONANT INVERTER WITH CAPACITIVE POWER COMPENSATION FOR MULTIPLE LAMP PARALLEL OPERATION

CROSS-REFERENCES TO RELATED APPLICATIONS

This application claims benefit of the following patent application which is hereby incorporated by reference: U.S. Provisional Patent Application No. 61/545,296, filed Oct. 10, 2011, entitled "Series Resonant Inverter with Capacitive Power Compensation for Multiple Lamp Parallel Operation."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

A ballast that can drive multiple parallel lamps is desirable because the ballast can maintain operation even if one or more of the connected lamps fail. This would reduce the cost of replacing lamps when some lamps fail, particularly in a high-bay lighting area. However, it is difficult to configure a resonant tank for an electronic ballast that can drive multiple parallel lamps without encountering hard-switching, which can damage the inverter switches instantly.

Referring now to FIG. 1, a simple low cost class D series resonant inverter 104 for multiple lamp operation is shown. A direct current (DC) voltage V_rail is supplied, for example, from a power factor correction circuit (not shown) in an electronic ballast. A switching controller 102 (e.g., an integrated circuit) is used to drive a half-bridge inverter formed by a high switch Q1 and a low switch Q2. Switches Q1 and Q2 may be MOSFETs or BJTs. A resonant inductor Lres and resonant capacitor Cres are the major resonant components that form a series resonant tank. A DC blocking capacitor C_dc is connected between the half-bridge inverter and the resonant inductor Lres. A plurality of output capacitors (C2, C3, C4, and C5) limits the lamp currents at certain frequencies. The ballast topology shown in FIG. 1 is inexpensive and reliable, but optimizing the resonant tank to insure multiple lamp operation without encountering hard switching is difficult if not impossible as described with respect to FIG. 2.

FIG. 2 shows resonant tank gain characteristics for one, two, three, and four parallel lamp loads. In FIG. 2, gain is represented by the output current as a function of operation frequency. The resonant tank resonant frequencies for one, two, three and four parallel lamp operation (see FIG. 1) are shown as $f_{res_1}$, $f_{res_2}$, $f_{res_3}$, and $f_{res_4}$, respectively. The resonant frequencies have a relationship of $f_{res_4}<f_{res_3}<f_{res_2}<f_{res_1}$. Steady state operation frequency for four parallel lamps is $f_{op}$, which is between $f_{res_4}$ and $f_{res_3}$. Typically, the switching controller 102 reduces the switching frequency from a maximum frequency to a minimum frequency, $f_{op}$, to start the lamps and maintain a steady state lamp current. During starting, the lamps will be ignited sequentially. As shown in FIG. 2, $f_{op}$ is greater than $f_{res_4}$, but less than $f_{res_3}$, $f_{res_2}$, and $f_{res_4}$ so that the series resonant inverter will go through capacitive mode load during the starting process. This capacitive mode load will cause hard-switching of the half-bridge inverter and may damage the switches Q1 and Q2. Thus, this simple and low cost topology is unreliable without hard-switching control.

BRIEF SUMMARY OF THE INVENTION

In one aspect of the invention, soft switching is insured for a half-bridge series resonant inverter regardless of changes in a load powered by the inverter.

In another aspect, a series resonant inverter is operable to provide alternating current (AC) power to an output of the series resonant inverter from a direct current (DC) power source having a power rail and a ground. The series resonant inverter includes a resonant inductor, a first clamping diode, and a second clamping diode. The resonant inductor has a first portion and a second portion and a connection point between the first portion and the second portion. The first clamping diode is connected between the connection point and the power rail. The second clamping diode is connected between the connection point and ground.

In another aspect, a ballast is operable to provide power to each lamp of a plurality of parallel connected lamps. The ballast includes a series resonant inverter and a plurality of output capacitors. The series resonant inverter is operable to provide alternating current (AC) power to an output of the series resonant inverter from a direct current (DC) power source having a power rail and a ground. The series resonant inverter includes a resonant inductor, a first clamping diode, and a second clamping diode. The resonant inductor has a first portion and a second portion and a connection point between the first portion and the second portion. The first clamping diode is connected between the connection point and the power rail. The second clamping diode is connected between the connection point and the ground. Each of the plurality of output capacitors is connected to the output of the series resonant inverter and is operable to connect to a corresponding lamp of the plurality of parallel lamps.

In another aspect, a light fixture includes a housing, a plurality of parallel lamps, and a ballast. The plurality of parallel lamps and the ballast are connected to the housing. The ballast is operable to provide power to each lamp of the plurality of parallel lamps. The ballast includes a series resonant inverter and a plurality of output capacitors. The series resonant inverter is operable to provide alternating current (AC) power to an output of the series resonant inverter from a direct current (DC) power source having a power rail and a ground. The series resonant inverter includes a resonant inductor, a first clamping diode, and a second clamping diode. The resonant inductor has a first portion and a second portion and a connection point between the first portion and the second portion. The first clamping diode is connected between the connection point and the power rail. The second clamping diode is connected between the connection point and the ground. Each of the plurality of output capacitors is connected to the output of the series resonant inverter and is operable to connect to a corresponding lamp of the plurality of parallel lamps.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As used herein, "ballast" refers to any circuit for providing power from a power source to a lamp. Additionally, "lamp" refers to one or more light emitting devices such as fluorescent lamps, high intensity discharge lamps, incandescent bulbs, and solid state light-emitting elements such as LEDs, organic light emitting diodes, and plasmaloids.

Figure 1:
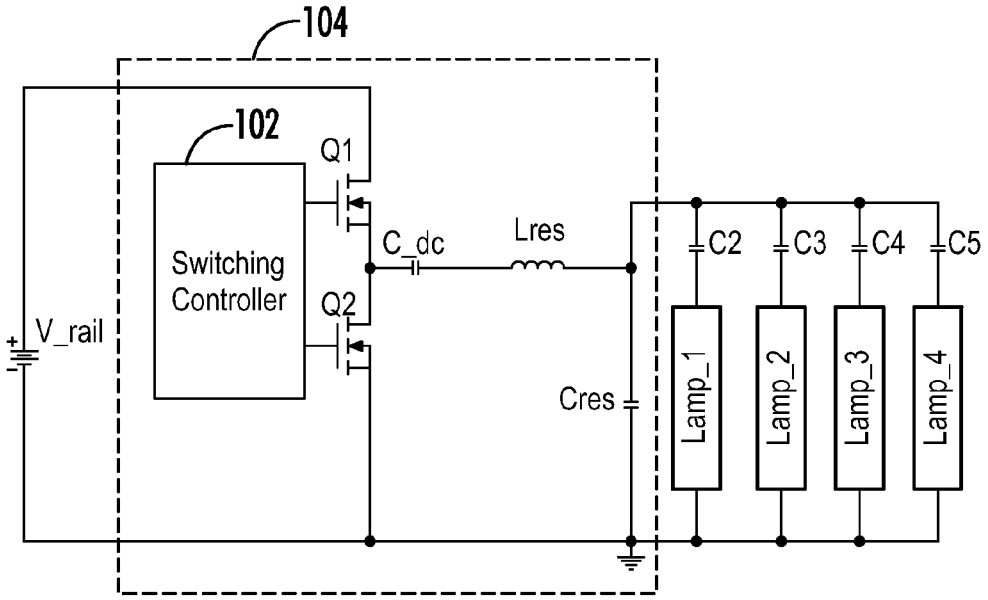
FIG. 1 (PRIOR ART)
FIG. 1 is a block diagram of an electronic ballast with a series resonant inverter as known in the prior art.
Figure 2:
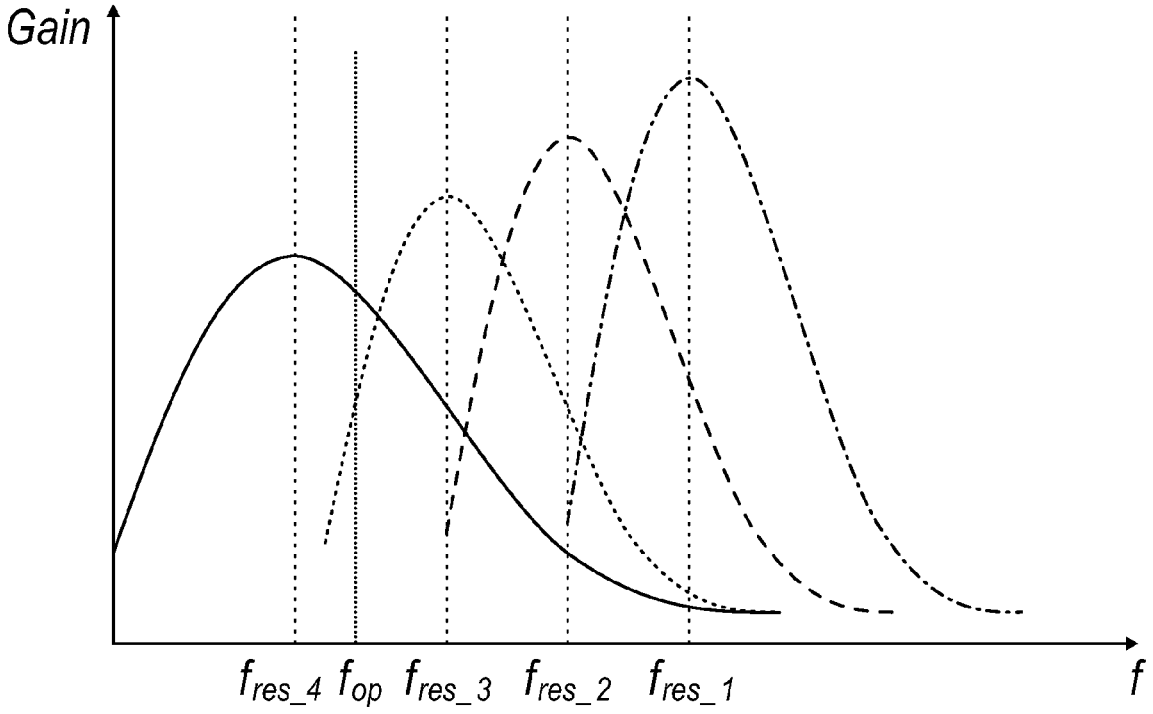
FIG. 2 (PRIOR ART)
FIG. 2 is a graph of gain versus frequency for different loads of the series resonant inverter of FIG. 1 driving a plurality of parallel lamps as known in the prior art.
Figure 3:
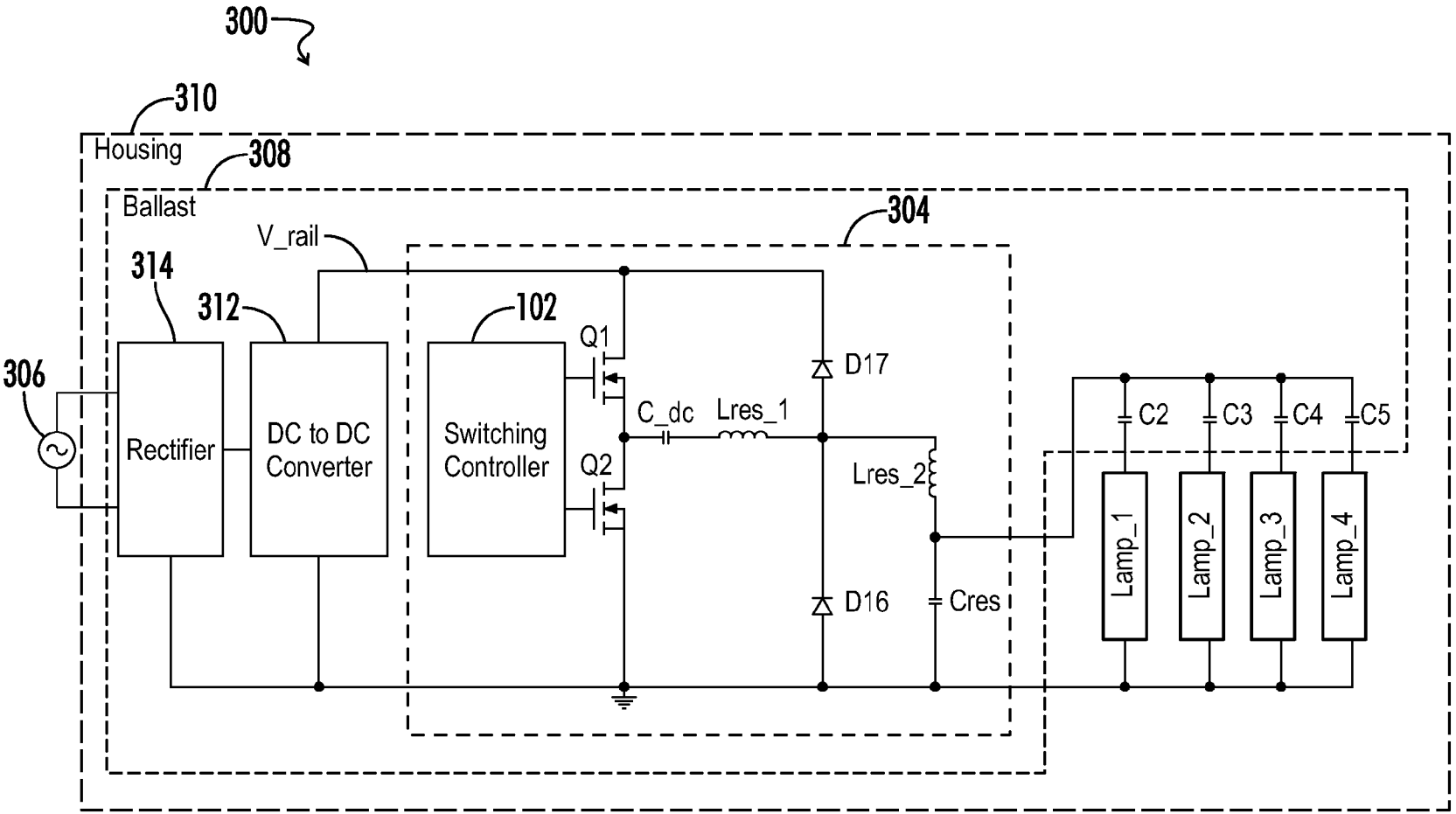
FIG. 3 is a block diagram and partial schematic diagram of one embodiment of a light fixture including an electronic ballast having a series resonant half-bridge inverter configured for multiple parallel lamp operation, in accordance with the present invention.

Referring to FIG. 3, a light fixture 300 includes a fixture housing 310, a ballast 308, and a plurality of parallel connected lamps (i.e., Lamp_1, Lamp_2, Lamp_3, and Lamp_4). The light fixture 300 receives power from a power source 306 and provides light from the plurality of parallel lamps. The ballast 308 and the plurality of parallel lamps are connected (i.e., physically and/or electrically) to the housing 310. The ballast 308 includes a rectifier 314, a DC to DC converter 312, a series resonant half-bridge inverter 304, and a plurality of output capacitors (i.e., C2, C3, C4, and C5). The rectifier 314 receives AC power from the power source 306 and provides a DC voltage to the DC to DC converter 312. The DC to DC converter 312 receives the DC voltage from the rectifier 314 and provides a boosted DC voltage V_rail to the series resonant inverter 304.

The series resonant inverter 304 provides AC power at an output of the series resonant inverter from a DC power source (e.g., the boosted DC voltage V_rail from the DC to DC converter 312). The DC power source provides a power rail V_rail and a ground. The series resonant inverter 304 includes a resonant inductor Lres, a first clamping diode D17, and a second clamping diode D16. The resonant inductor Lres has a first portion Lres_1 and a second portion Lres_2. The resonant inductor has a connection point formed between the first portion Lres_1 and the second portion Lres_2. The first clamping diode D17 is connected between the connection point and the power rail. The second clamping diode D16 is connected between the connection point and ground. Each output capacitor of the plurality of output capacitors (i.e., C2, C3, C4, and C5) is connected between the output of the series resonant inverter 304 and a corresponding lamp of the plurality of parallel lamps (i.e., Lamp_1, Lamp_2, Lamp_3, and Lamp_4).

The series resonant inverter 304 also includes a switching controller 102, a pair of switches in a half-bridge configuration (i.e., a high switch Q1 and a low switch Q2), resonant capacitor Cres, and a direct current (DC) blocking capacitor C_dc. The switching controller 102 controls switching of the half-bridge inverter switch pair (i.e., a high switch Q1 and a low switch Q2). The resonant capacitor Cres is connected between the output of the series resonant inverter 304 and ground. The resonant inductor Lres has a first side and a second side. The first side of the resonant inductor Lres is coupled to an output of the half-bridge inverter switch pair (i.e., the node between the high switch Q1 and the low switch Q2). The second side of the resonant inductor Lres is coupled to an output of the series resonant inverter 304. The DC blocking capacitor C_dc is connected between the output of the half-bridge inverter switch pair and the first side of the resonant inductor Lres. The series resonant inverter 304 is operable to maintain soft switching regardless of any changes in the load coupled to the output of the series resonant inverter 304. That is, if any of the plurality of parallel lamps malfunction or are removed, or if all of the plurality of parallel lamps (i.e., Lamp_1, Lamp_2, Lamp_3, and Lamp_4) are present and functioning, the series resonant inverter 304 maintains soft switching while supplying AC power to the available (i.e. connected and functional) lamps.

The first clamping diode D17, the second clamping diode D16, the resonant inductor formed by the first portion Lres_1 and the second portion Lres_2, and the resonant capacitor Cres form a soft-switching controlled resonant tank. The voltage across the second portion Lres_2 of the resonant inductor and the resonant capacitor Cres is clamped by the first clamping diode D17 and the second clamping diode D16. The maximum peak voltage is clamped to the power rail voltage V_rail and the minimum voltage is clamped to ground (i.e., 0 V). The second portion Lres_2 of the resonant inductor and the resonant capacitor Cres form a series resonant tank that provides a starting voltage and necessary gain for multiple parallel lamp operation. The first portion Lres_1 of the resonant inductor is part of the resonant tank and is used to control the tank circulating current.

The principle by which the soft-switching control tank ensures and maintains soft-switching behavior of the main resonant tank regardless of changes in the load (i.e., the number of lamps connected and functional to the series resonant inverter 304) is explained as follows:

The output voltage of the half-bridge inverter (i.e., the voltage at the node between the high switch Q1 and the low switch Q2) is V_half_bridge. V_half_bridge is the input of the soft-switching controlled resonant tank. The voltage between the first clamping diode D16 and the second clamping diode D17 (i.e., at the connection point between the first portion of the resonant inductor Lres_1 and the second portion of the resonant inductor Lres_2) is designated as V_clamp.

V_clamp is the input of the series resonant tank. The relationship between V_half_bridge and V_clamp is shown in the timing diagram of FIG. 4.

Figure 4:
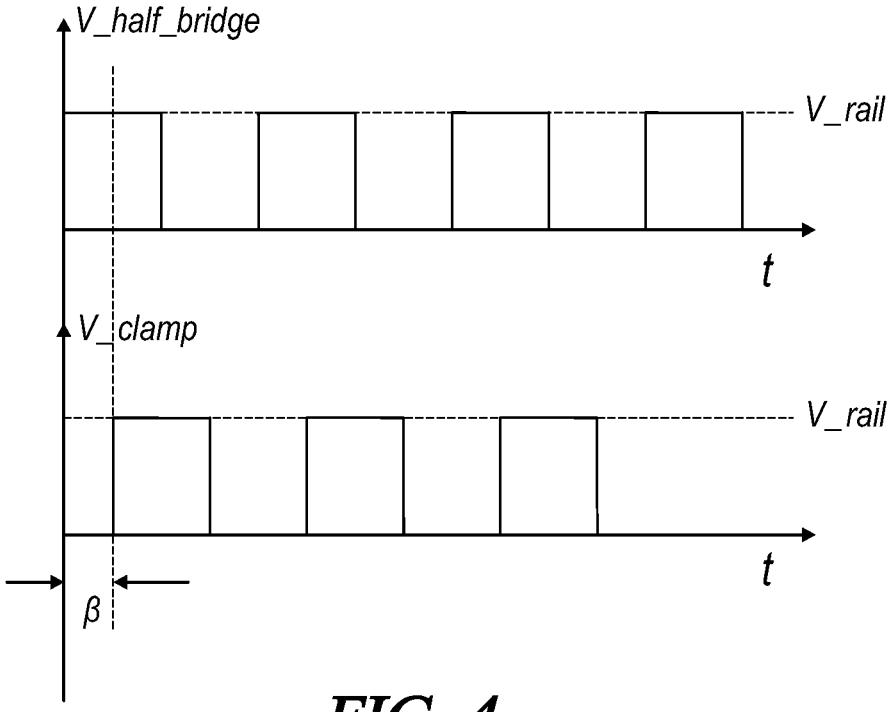
FIG. 4 is a timing diagram of the output voltage of the half-bridge inverter and a voltage of the connection point of the resonant inductor of the ballast and light fixture of FIG. 3.

Referring to FIG. 4, there is a phase shift β between V_half_bridge and V_clamp. The phase shift β can vary between −180 degrees to 180 degrees. If V_half_bridge is selected as the 0 degree reference, then V_half_bridge and V_clamp can be expressed as shown in Equations (1) and (2).

$$\text{V_half_bridge} = \frac{\text{V_rail}}{2} \tag{1}$$

$$\text{V_clamp} = \frac{\text{V_rail}}{2} \cdot (\cos(\beta) + j\sin(\beta)) \tag{2}$$

The voltage across the resonant inductor (i.e., V_res) can be expressed as shown in Equation (3).

$$\text{V_res} = \text{V_half_bridge} - \text{V_clamp} = \frac{\text{V_rail}}{2} \cdot (1 - \cos(\beta) - j\sin(\beta)) \tag{3}$$

The current through the resonant inductor (i.e., I_res) can be expressed as shown in Equation (4) where the inductance of the first portion of the resonant inductor Lres_1 is expressed as $L_{res}$.

$$\text{I_res}\angle\alpha = \frac{\frac{\text{V_rail}}{2} \cdot (1 - \cos(\beta) - j\sin(\beta))}{j \cdot \omega \cdot L_{res}} \tag{4}$$

In Equation (4), the phase angle for V_res can vary from −90 to 90 degrees and the phase angle for $j \cdot \omega L_{res}$ is 90 degrees. Thus, the phase of I_res can vary from −180 to 0 degrees.

It follows that α is between −180 and 0 degrees which means that the main tank current I_res is always lagging the input voltage of the soft-switching controlled resonant tank, V_half_bridge. This condition ensures half-bridge soft-switching.

Thus, the series resonant inverter 304 will always exhibit soft-switching behavior of the half-bridge inverter switch pair, regardless of any load characteristics and changes in the load.

According to the operation of this soft-switching control, the second portion of the resonant inductor Lres_2 and the first and second clamping diodes D16 and D17 automatically compensate the capacitive power of the resonant tank to ensure inductive switching or soft-switching. The first clamping diode D17 bypasses the energy whenever the voltage across the second clamping diode D16 is greater than the power rail V_rail such that it seems that there is an equivalent capacitor Ceq in parallel with the second clamping diode D16. This equivalent capacitor Ceq is always large enough to reduce the circuit resonant frequency below the minimum operating frequency $f_{op}$ such that the resonant tank remains in an inductive mode. In other words, the equivalent capacitor Ceq is large enough to compensate for enough current going through the first portion of the resonant inductor Lres_1 to increase the inductive power in the resonant tank and force the resonant tank to be an inductive load, the necessary condition for half-bridge soft-switching.

Figure 5:
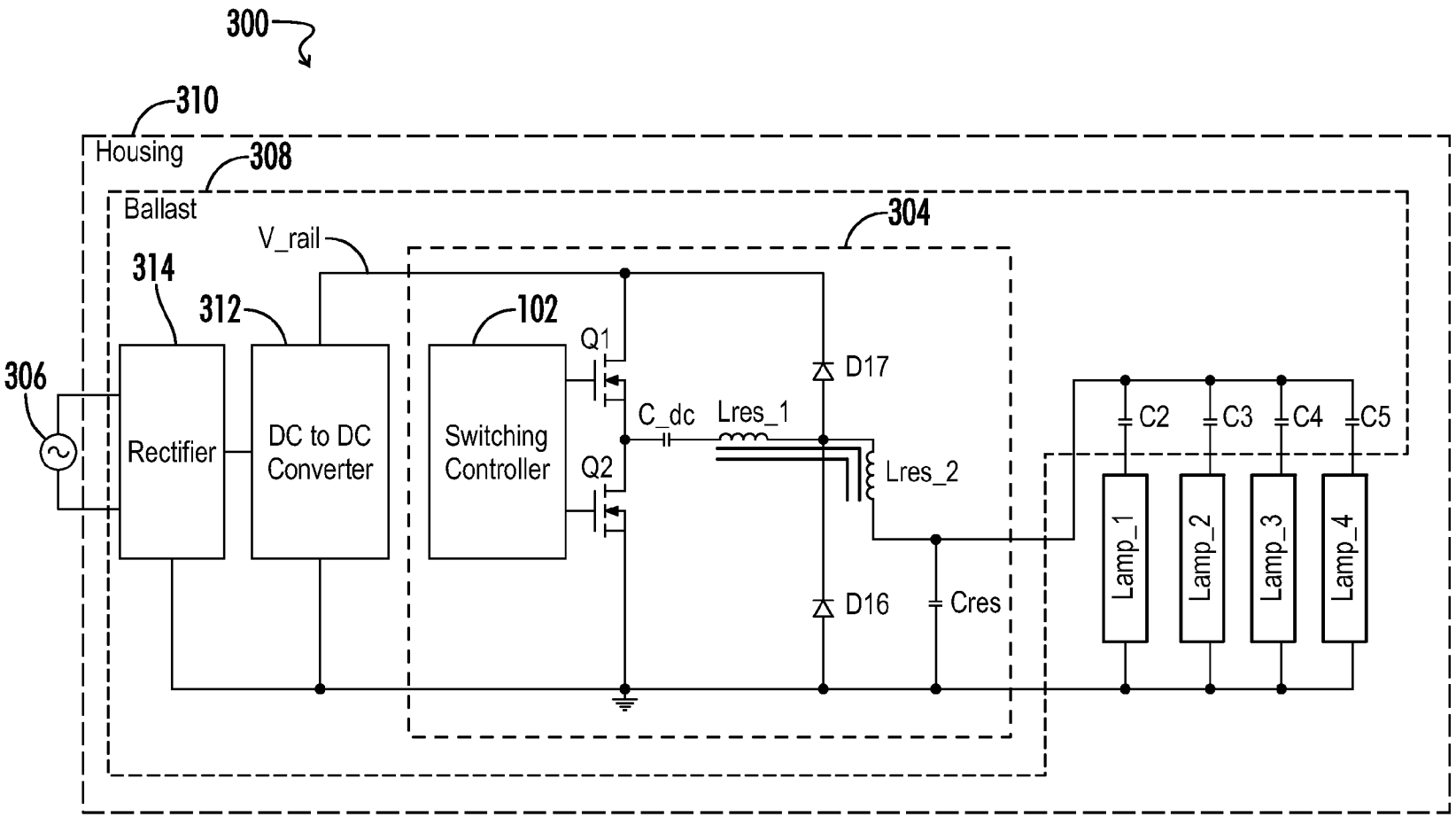
FIG. 5 is a block diagram and partial schematic diagram of another embodiment of a light fixture including an electronic ballast having a series resonant half-bridge inverter configured for multiple parallel lamp operation, in accordance with the present invention.

Referring to FIG. 5 in one embodiment, the first portion of the resonant inductor Lres_1 and the second portion of the resonant inductor Lres_2 share a common magnetic core.

It will be understood by those of skill in the art that information and signals may be represented using any of a variety of different technologies and techniques (e.g., data, instructions, commands, information, signals, bits, symbols, and chips may be represented by voltages, currents, electromagnetic waves, magnetic fields or particles, optical fields or particles, or any combination thereof). Likewise, the various illustrative logical blocks, modules, circuits, and algorithm steps described herein may be implemented as electronic hardware, computer software, or combinations of both, depending on the application and functionality. Moreover, the various logical blocks, modules, circuits, and controllers described herein may be implemented or performed with a general purpose processor (e.g., microprocessor, conventional processor, controller, microcontroller, state machine or combination of computing devices), a digital signal processor ("DSP"), an application specific integrated circuit ("ASIC"), a field programmable gate array ("FPGA") or other programmable logic device, discrete gate or transistor logic, discrete hardware components, or any combination thereof designed to perform the functions described herein. Similarly, steps of a method or process described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. Although embodiments of the present invention have been described in detail, it will be understood by those skilled in the art that various modifications can be made therein without departing from the spirit and scope of the invention as set forth in the appended claims.

A controller, computing device, or computer, such as described herein, includes at least one or more processors or processing units and a system memory. The controller may also include at least some form of computer readable media. By way of example and not limitation, computer readable media may include computer storage media and communication media. Computer readable storage media may include volatile and nonvolatile, removable and non-removable media implemented in any method or technology that enables storage of information, such as hard coding, computer readable instructions, data structures, program modules, or other data. Communication media may embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A series resonant inverter operable to provide alternating current (AC) power at an output of the series resonant inverter from a direct current (DC) power source having a power rail and a ground, said series resonant inverter comprising:

a resonant inductor having a first portion coupled to a second portion at a connection point between the first portion and the second portion;

a first clamping diode connected between the connection point and the power rail;

a second clamping diode connected between the connection point and the ground; and wherein the first portion and the second portion of the resonant inductor share a magnetic core.

2. The series resonant inverter of claim 1, further comprising:

a half-bridge inverter switch pair having an output;

a switching controller operable to control switching of the half-bridge inverter switch pair; and a resonant capacitor connected between the output of the series resonant inverter and ground, wherein the resonant inductor has a first side and a second side, the first side of the resonant inductor is connected to the output of the half-bridge inverter switch pair, the second side of the resonant inductor is connected to the output of the series resonant inverter.

3. The series resonant inverter of claim 1, further comprising:

a half-bridge inverter switch pair having an output;

a switching controller operable to control switching of the half-bridge inverter switch pair;

a resonant capacitor connected between the output of the series resonant inverter and ground;

the resonant inductor has a first side and a second side, the first side of the resonant inductor is connected to the output of the half-bridge inverter switch pair, the second side of the resonant inductor is connected to the output of the series resonant inverter; and a direct current (DC) blocking capacitor connected between the output of the half-bridge inverter switch pair and the first side of the resonant inductor.

4. The series resonant inverter of claim 1, wherein the series resonant inverter is operable to maintain inductive switching independent of changes in a load connected to the output of the series resonant inverter while the load is receiving the AC power from the series resonant inverter.

5. The series resonant inverter of claim 1, wherein the first portion of the resonant inductor is a first resonant inductor, and the second portion of the resonant inductor is a second resonant inductor distinct from the first resonant inductor.

6. A ballast operable to provide power to each lamp of a plurality of parallel lamps, said ballast comprising:

a series resonant inverter operable to provide alternating current (AC) power at an output of the series resonant inverter from a direct current (DC) power source having a power rail and a ground, said series resonant inverter comprising a resonant inductor having a first portion and a second portion and a connection point between the first portion and the second portion, a first clamping diode connected between the connection point and the power rail, and a second clamping diode connected between the connection point and the ground;

a plurality of output capacitors, each output capacitor of the plurality of output capacitors connected to the output of the series resonant inverter and configured to connect to a corresponding lamp of the plurality of parallel lamps; and wherein the first portion and the second portion of the resonant inductor share a magnetic core.

7. The ballast of claim 6, wherein the series resonant inverter further comprises:

a half-bridge inverter switch pair having an output;

a switching controller operable to control switching of the half-bridge inverter switch pair;

a resonant capacitor connected between the output of the series resonant inverter and ground; and wherein the resonant inductor has a first side and a second side, the first side of the resonant inductor is connected to the output of the half-bridge inverter switch pair, the second side of the resonant inductor is connected to the output of the series resonant inverter.

8. The ballast of claim 6, wherein the series resonant inverter further comprises:

a half-bridge inverter switch pair having an output;

a switching controller operable to control switching of the half-bridge inverter switch pair; and a resonant capacitor connected between the output of the series resonant inverter and ground;

the resonant inductor has a first side and a second side, the first side of the resonant inductor is connected to the output of the half-bridge inverter switch pair, the second side of the resonant inductor is connected to the output of the half-bridge inverter; and a direct current (DC) blocking capacitor connected between the output of the half-bridge inverter switch pair and the first side of the series resonant inverter.

9. The ballast of claim 6, wherein the series resonant inverter is operable to maintain inductive switching in response to a change in a load connected to the output of the series resonant inverter while the load is receiving AC power from the series resonant inverter.

10. The ballast of claim 6, wherein the first portion of the resonant inductor is a first resonant inductor, and the second portion of the resonant inductor is a second resonant inductor distinct from the first resonant inductor.

11. The ballast of claim 6, further comprising:

a rectifier operable to receive AC power from a power source and provide a DC voltage; and a DC to DC converter operable to receive the DC voltage from the rectifier and provide a boosted DC voltage to the series resonant inverter, wherein the DC to DC converter is the DC power source and the boosted DC voltage is the DC power source.

12. A light fixture comprising:

a housing;

a plurality of parallel lamps connected to the housing;

a ballast connected to the housing, operable to provide power to each lamp of the plurality of parallel lamps, said ballast comprising a series resonant inverter operable to provide alternating current (AC) power at an output of the series resonant inverter from a direct current (DC) power source having a power rail and a ground, said series resonant inverter comprising a resonant inductor having a first portion and a second portion and a connection point between the first portion and the second portion, a first clamping diode connected between the connection point and the power rail, and a second clamping diode connected between the connection point and the ground;

a plurality of output capacitors, each output capacitor of the plurality of output capacitors connected to the output of the series resonant inverter and operable to connect to a corresponding lamp of the plurality of parallel lamps; and wherein the first portion and the second portion of the resonant inductor share a magnetic core.

13. The light fixture of claim 12, wherein the series resonant inverter further comprises:

a half-bridge inverter switch pair having an output;

a switching controller operable to control switching of the half-bridge inverter switch pair; and a resonant capacitor connected between the output of the series resonant inverter and ground, wherein the resonant inductor has a first side and a second side, the first side of the resonant inductor is connected to the output of the half-bridge inverter switch pair, the second side of the resonant inductor is connected to the output of the series resonant inverter.

14. The light fixture of claim 12, wherein the series resonant inverter further comprises:

a half-bridge inverter switch pair having an output;

a switching controller operable to control switching of the half-bridge inverter switch pair;

a resonant capacitor connected between the output of the series resonant inverter and ground;

wherein the resonant inductor has a first side and a second side, the first side of the resonant inductor is connected to the output of the half-bridge inverter switch pair, the second side of the resonant inductor is connected to the output of the series resonant inverter; and a direct current (DC) blocking capacitor connected between the output of the half-bridge inverter switch pair and the first side of the resonant inductor.

15. The light fixture of claim 12, wherein the series resonant inverter is operable to maintain inductive switching regardless of a change in a load connected to the output of the series resonant inverter while the load is receiving AC power from the series resonant inverter, wherein the load is the plurality of parallel lamps.

16. The light fixture of claim 12, wherein the first portion of the resonant inductor is a first resonant inductor, and the second portion of the resonant inductor is a second resonant inductor distinct from the first resonant inductor.

17. The light fixture of claim 12, wherein the ballast further comprises:

a rectifier operable to receive AC power from a power source and provide a DC voltage; and a DC to DC converter operable to receive the DC voltage from the rectifier and provide a boosted DC voltage to the series resonant inverter, wherein the DC to DC converter is the DC power source and the boosted DC voltage is the DC power source.

* * * * *